US005483730A

United States Patent [19]

Hoover

[11] Patent Number: 5,483,730

[45] Date of Patent: Jan. 16, 1996

[54] APPARATUS AND METHOD FOR FORMING COILS OF YARN AND FOR HEAT SETTING THE SAME

[75] Inventor: Donald L. Hoover, Cramerton, N.C.

[73] Assignee: American Linc Corporation, Gastonia, N.C.

[21] Appl. No.: 289,937

[22] Filed: Aug. 12, 1994

[51] Int. Cl.[6] ..... D02G 1/00

[52] U.S. Cl. ..... 28/289; 28/101; 28/219; 242/361

[58] Field of Search ..... 28/219, 221, 266, 28/289, 101; 242/361, 361.4, 363

[56] References Cited

U.S. PATENT DOCUMENTS

| | | | |
|---|---|---|---|
| 2,982,000 | 5/1961 | Gonsalves . | |
| 3,270,977 | 9/1966 | Tillou, II | 242/361 |
| 3,469,796 | 9/1969 | Russell et al. | 28/289 X |
| 3,470,587 | 10/1969 | Kincaid . | |
| 3,618,184 | 11/1971 | Pearce et al. . | |
| 3,644,968 | 2/1972 | Elliott et al. . | |
| 3,667,092 | 6/1972 | Engels . | |
| 3,964,691 | 6/1976 | Pearce et al. . | |
| 4,089,720 | 5/1978 | Haley . | |
| 4,185,064 | 1/1980 | Schippers | 28/289 X |
| 4,221,345 | 9/1980 | Schippers et al. . | |
| 4,318,206 | 3/1982 | Ferri et al. . | |
| 4,372,010 | 2/1983 | Gauvain . | |
| 4,408,378 | 10/1983 | Ketteringham et al. . | |
| 4,700,538 | 10/1987 | Varga et al. . | |
| 4,773,607 | 9/1988 | Missout et al. . | |
| 4,785,510 | 11/1988 | Asfour | 28/289 |
| 4,825,630 | 5/1989 | Czelusniak, Jr. et al. . | |
| 4,833,872 | 5/1989 | Czelusniak, Jr. et al. . | |
| 4,967,449 | 11/1990 | Gasser . | |
| 5,024,390 | 6/1991 | Enderlin . | |
| 5,287,598 | 2/1994 | Günter et al. . | |

FOREIGN PATENT DOCUMENTS

| | | | |
|---|---|---|---|
| 1602027 | 11/1970 | France | 28/289 |
| 2381705 | 10/1978 | France | 28/289 |

*Primary Examiner*—John J. Calvert
*Attorney, Agent, or Firm*—Bell, Seltzer, Park & Gibson

[57] ABSTRACT

An apparatus and method are provided for forming coils of yarn and for heat setting the yarn. The apparatus has a coiler adapted to receive yarn from a yarn source and to form the yarn into a plurality of overlapping loops of a desired size. The coiler preferably includes a supporting frame, a pair of feed rolls mounted on the supporting frame and adapted for feeding yarn from a yarn source, and a rotatable coiler tube positioned downstream from and cooperating with the feed rolls. The coiler also includes a first variable speed drive connected to the pair of feed rolls and adapted for rotating the same at a predetermined speed and a second variable speed drive connected to the coiler tube and adapted for rotating the same at a speed to thereby form loops of yarn of a desired size. The apparatus further has a conveyor positioned below the rotatable coiler tube for receiving overlapping loops of yarn thereon. A heating oven is positioned downstream from the coiler and through which the conveyor extends to thereby effect heat setting of the yarn carried thereon.

51 Claims, 6 Drawing Sheets

7
24
25
24b
39
111a
41
34
102
31a
111
114
35
36
32a
110
101
101
70
78
44
101
31
32
122
123
142
65
52
62
63
64
62
50
56
55
61
61
100
θ
121
126
126
51
93b
53
93a
93b
90
93
93
7

APPARATUS AND METHOD FOR FORMING COILS OF YARN AND FOR HEAT SETTING THE SAME

FIELD OF THE INVENTION

This invention relates to an apparatus and method for forming coils of yarn and, more particularly, to an apparatus for forming coils of yarn and for feeding the coiled yarn into a heat treatment zone to thereby heat set the yarn.

BACKGROUND OF THE INVENTION

During the production of continuous filamentary or spun yarns, for example, the yarns are often conventionally subjected to a drawing or stretching process under tension. This stretching process is followed by a partial or complete relaxing of the yarn to produce the desired physical characteristics, such as a reduced shrinkage propensity in the processed yarn or some other effect, i.e., bulking or crimping of the filaments forming the yarn. Such yarns may have an inherent tendency to retract into a crimped form under low tension. Heat may also be used to assist this process.

Conventionally, the relaxation of yarn has been accomplished by a type of batch process wherein the yarn is temporarily collected in some form of can or box which allows a degree of contraction to take place such as seen in U.S. Pat. No. 3,470,587 by Kincaid titled "Planetary Coiler." Other processes are also known such as continuously subjecting the fed yarn to treatment with a hot fluid in some form of jet device such as seen in U.S. Pat. No. 3,644,968 by Elliott et al. titled "Apparatus For Relaxing Yarns." These prior methods, however, involve a relatively slow batch process, primarily provide only one pattern or type of crimp in the yarn, provide limited production output, and provide little control over the production process.

OBJECTS AND SUMMARY OF THE INVENTION

It is, therefore, an object of the present invention to provide a versatile apparatus and method for forming a plurality of patterns in yarn having either a desired crimp or substantially no crimp therein.

It is also an object of the present invention to provide an apparatus and method of coiling yarn that is adaptable to a plurality of sizes of yarns and a plurality of rates of production for various yarn patterns.

The above and other objects and advantages of the present invention are achieved in the embodiments described herein by the provision of an apparatus and method of forming coils of yarn and for feeding the yarn to and through a heating zone so as to effect heat setting of the yarn. The apparatus preferably has a coiler, a conveyor cooperating with the coiler, and an enclosed heating oven cooperating with the conveyor. The coiler has a pair of feed rolls adapted for feeding yarn from a yarn source and a rotatable coiler tube positioned adjacent the feed rolls and extending vertically downward therefrom. The apparatus also provides first drive means for driving the pair of feed rolls of the coiler at a variable speed and second drive means for driving the coiler tube of the coiler at a variable speed. By providing the combination of these variable speed drives for the coiler, for example, in situations where high production output of yarn is important, the user of the apparatus can advantageously adjust the feed rate of yarn through the coiler to maximize the throughput of the yarn on the conveyor fed into and through the heating oven. Also, based on the desired throughput, the user can then adjust the drive rate of the coiler tube to select a predetermined pattern of loops in the yarn. For example, the faster the drive rate of the coiler tube, more larger-sized loops are formed in the yarn. The slower the drive rate of the coiler tube, fewer larger-sized loops and more smaller-sized loops are formed in the yarn.

More particularly, the apparatus, according to the invention, preferably has a coiler adapted to receive yarn from a yarn source and to form the yarn into a plurality of loops of a desired size. The coiler preferably includes a supporting frame, a pair of feed rolls mounted on the supporting frame and adapted for feeding yarn from a yarn source, and a rotatable coiler tube positioned downstream from and cooperating with the feed rolls. The coiler tube is vertically positioned for facilitating the travel of yarn from the feed rolls to and through the coiler tube. The coiler also includes a first variable speed drive connected to the pair of feed rolls and adapted for rotating the same at a predetermined speed, and a second variable speed drive connected to the coiler tube and adapted for rotating the same at a speed so as to form loops of yarn of a desired size. The apparatus further has a conveyor positioned below the rotatable coiler tube and adapted for receiving loops of yarn thereon. The conveyor extends a predetermined distance from the coiler tube. An enclosed heating oven is positioned downstream from the coiler and receives portions of the conveyor therein for heating the loops of yarn carried thereon so as to effect heat setting of the yarn.

Also, according to the present invention, an apparatus is provided having a series of coilers positioned in a generally side-by-side arrangement and adapted for forming loops of yarn. A plurality of yarn supply packages are each preferably positioned to feed yarn to a respective one of the series of coilers. A series of conveyors extend generally parallel to each other. Each of the conveyors is positioned vertically below a respective coiler, extends a predetermined distance therefrom, and is adapted for receiving loops of yarn thereon. Enclosed heating means is preferably positioned downstream from the series of coilers and receives portions of each of the series of conveyors therein for heating the loops of yarn carried thereon so as to effect heat setting of the yarn. The series of coilers includes a common supporting frame having a horizontal plate and a plurality of vertical plates extending downwardly therefrom. Each of the coilers of the series is adapted to form yarn received from a yarn supply package into a plurality of loops of a desired size. Each coiler also preferably includes a pair of feed rolls mounted on the horizontal plate of the supporting frame and adapted for feeding yarn from the yarn supply package and a rotatable coiler tube positioned downstream from and cooperating with the feed rolls. The coiler tube is preferably vertically positioned for facilitating the travel of yarn from the feed rolls to and through the coiler tube. The coiler further includes a first variable speed drive connected to the pair of feed rolls and adapted for rotating the same at a predetermined speed, and a second variable speed drive connected to the coiler tube and adapted for rotating the same at a speed so as to form loops of yarn of a desired size.

Further, according to the present invention, methods of forming coils in a yarn are also provided. The method preferably includes the steps of providing a first variable speed drive connected to a pair of feed rolls and providing a second variable speed drive connected to a rotatable coiler tube. The pair of feed rolls and the rotatable coiler tube are then rotatingly driven respectively responsive to the first and second variable speed drives at such speeds so as to form loops of yarn of a desired size deposited on a conveyor.

BRIEF DESCRIPTION OF THE DRAWINGS

Some of the objects and advantages of the present invention having been stated, others will become apparent as the description proceeds when taken in conjunction with the accompanying drawings, in which.

DETAILED DESCRIPTION OF A PREFERRED EMBODIMENT

The present invention now will be described more fully hereinafter with reference to the accompanying drawings in which typical preferred embodiments of the invention are shown. This invention may, however, be embodied in many different forms and should not be construed as limited to the illustrated embodiments set forth herein; rather, these embodiments are provided so that this disclosure will be thorough and complete and will fully convey the scope of the invention to those skilled in the art. Like numbers refer to like elements throughout.

Figure 1:
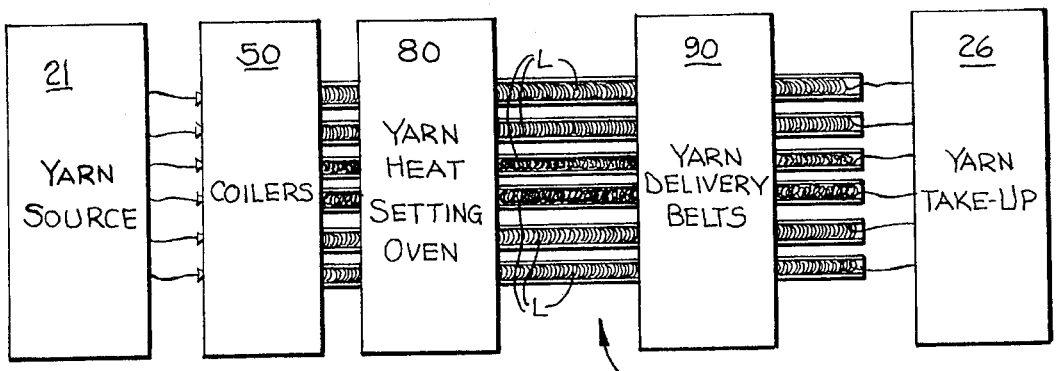
FIG. 1 schematically illustrates a top plan view of an apparatus having a series of coilers for forming coils of yarn and feeding the yarn into and through an enclosed heat setting oven according to the present invention.
Figure 2:
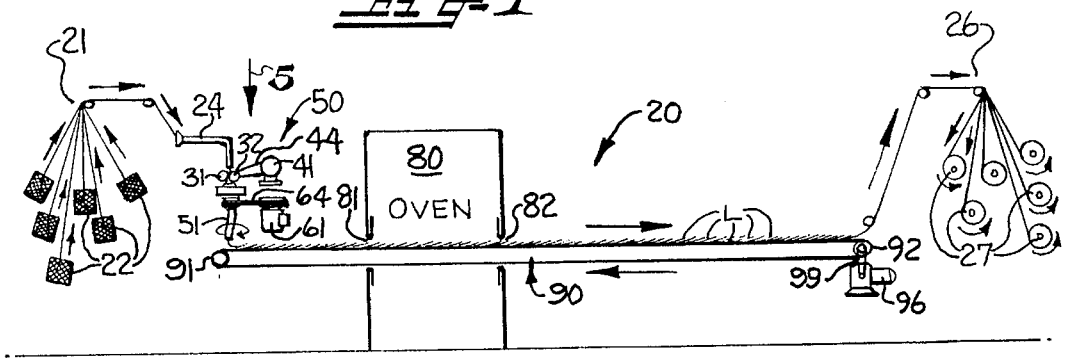
FIG. 2 schematically illustrates a side elevational view of an apparatus for forming coils of yarn and feeding the yarn into and through an enclosed heat setting oven according to the present invention.

FIGS. 1 and 2 schematically illustrate an apparatus, broadly designated at 20, for forming coils of yarn having a series of coilers 50 according to the present invention. FIG. 2 schematically illustrates a side plan view of an apparatus 20 for forming coils of yarn Y and for feeding the coiled yarn Y to a heating zone, shown in the form of an enclosed heat setting oven generally at 80, according to the present invention. FIG. 1 schematically illustrates in a top plan view an apparatus 20 according to the invention having a series of coilers, broadly designated at 50, positioned adjacent each other and yet, for example, sharing the same enclosed heating means for heating the yarn Y, i.e., the heat setting oven 80, such as in a production facility or the like. This type of configuration can be of particular interest where, for example, a high production output of the yarn Y is important to the user of the apparatus 20.

As also illustrated in FIGS. 1 and 2, the apparatus 20 preferably includes a yarn source 21 which is illustrated as a plurality of yarn supply packages 22 and which is positioned to feed yarn Y to be coiled to each of the respective coilers 50. Although the invention includes an apparatus having one or more coilers 50, the initial description herein will generally discuss an apparatus 20 having one coiler 50 and then describe an apparatus 20 having a series of coilers 50. The coiler 50 cooperates with the yarn source 21 and is adapted for forming coils in the supplied yarn Y. The preferred supply path and flow of the yarn Y to and through the coiler 50 and the heating oven 80 are schematically illustrated in FIG. 2 by the arrows. The supplied yarn Y preferably is either continuous filament yarn or spun yarn.

The apparatus 20 also preferably includes a conveyor 90 positioned below the coiler 50 that cooperates with the coiler 50 and the heat setting oven 80. The conveyor 90 is adapted for receiving loops L of yarn Y thereon and feeds the yarn Y from the coiler 50 to and through the enclosed heat setting oven 80. The yarn heat setting oven 80 is positioned downstream from the coiler 50 (FIG. 1) and receives portions of the conveyor 90 therein for heating the loops L of yarn Y carried thereon to thereby effect a heat setting treatment to the yarn Y. After the yarn Y passes through the heat setting oven 80 on portions of the conveyor 90, the yarn Y is preferably cooled by exposure to air, other gases, or the like and taken-up by yarn take-up means, generally designated at 26, which is illustrated as a plurality of rollers and winders for individually winding the yarn Y to form individual packages 27 thereof. The yarn take-up means 26 preferably supplies the needed tension to take-up the yarn Y from the conveyor 90 in a smoothly operable manner so that entanglement or other problems do not occur when receiving the yarn Y.

Figure 6:
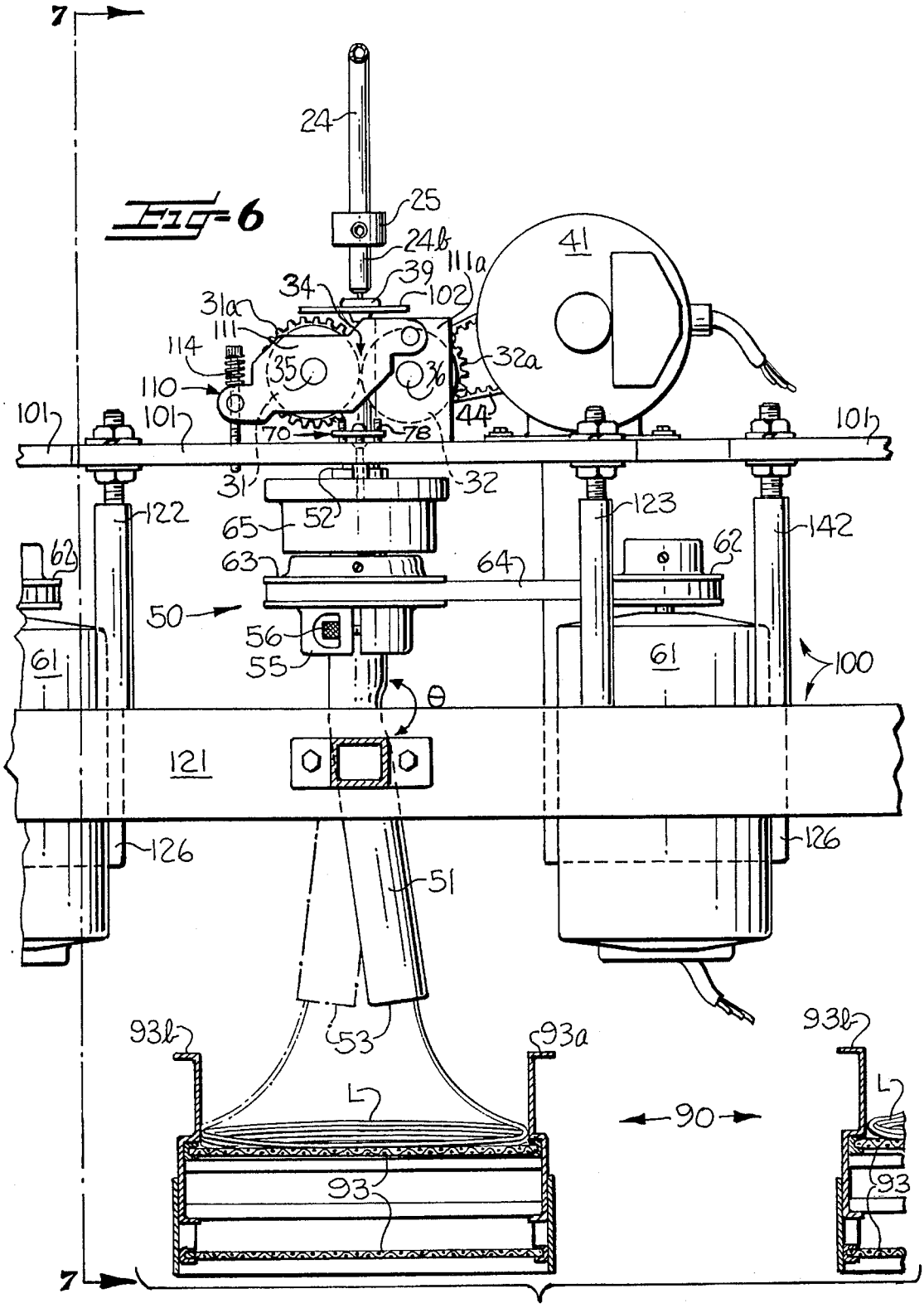
FIG. 6 illustrates a fragmentary side elevational view of an apparatus for forming coils of yarn taken along line 6—6 of FIG. 5 and rotatingly driving of a coiler tube at one predetermined speed so as to form a shape substantially taking the form of a plurality of loops of a larger-sized diameter on a conveyor according to the present invention.
Figure 7:
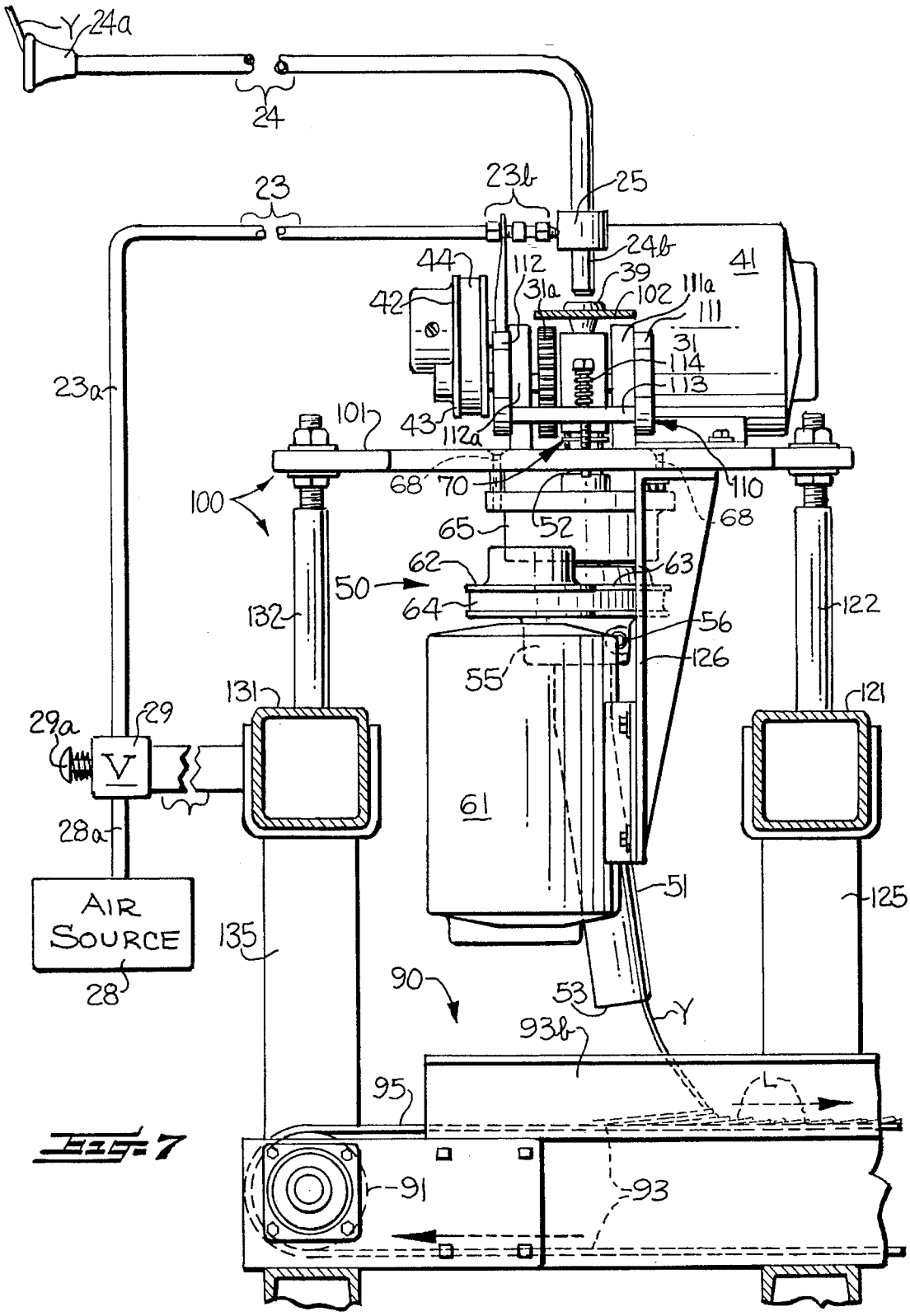
FIG. 7 illustrates a fragmentary front elevational view of an apparatus for forming coils of yarn taken along line 7—7 of FIG. 6 and rotatingly driving of a coiler tube at a second predetermined speed so as to form a plurality of loops of a smaller-sized diameter on a conveyor belt according to the present invention.
Figure 8:
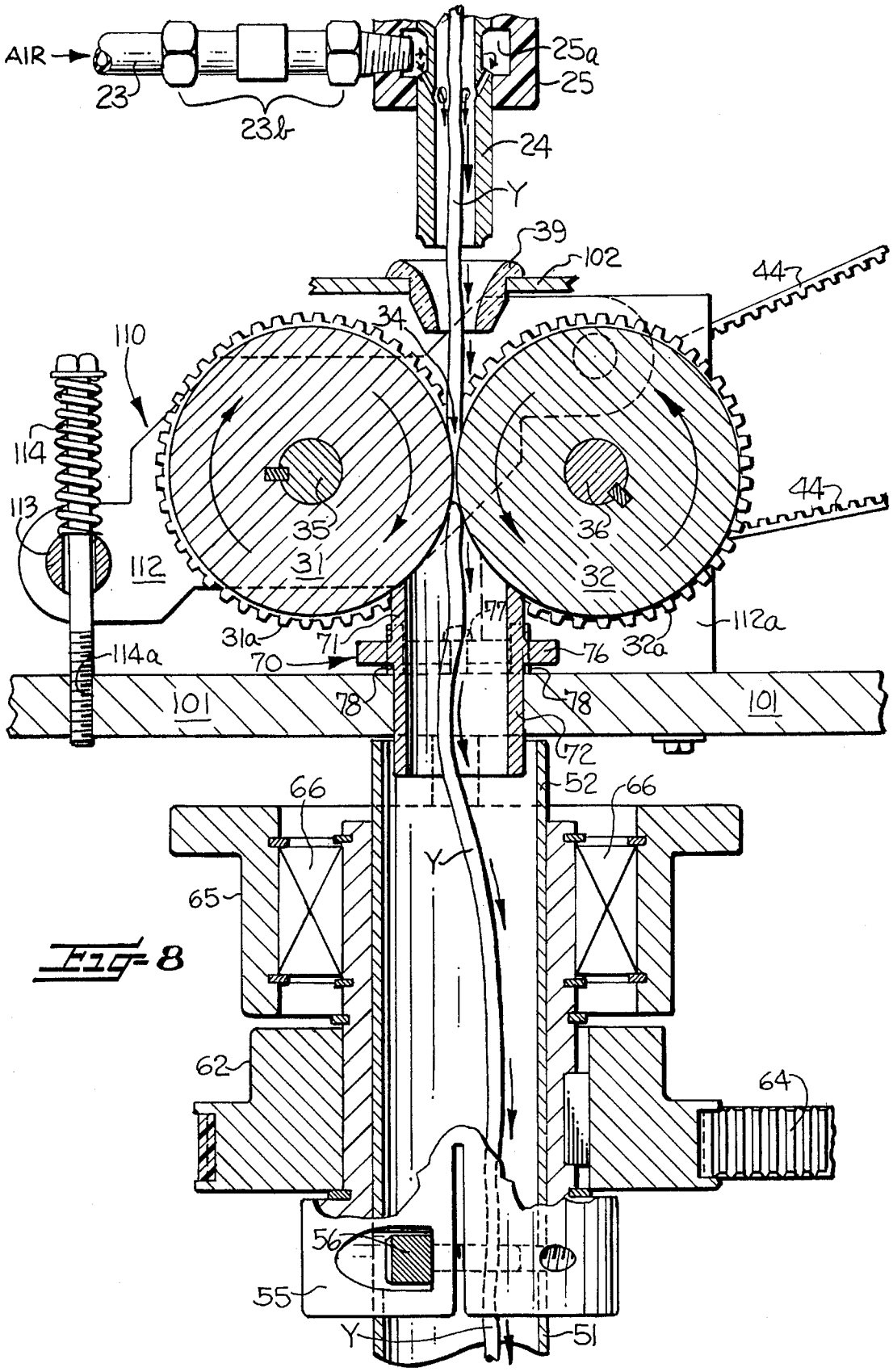
FIG. 8 illustrates a fragmentary vertical sectional view of an apparatus for forming coils of yarn taken along line 8—8 of FIG. 5 and illustrating the operation of a pair of feed rolls and the travel of the yarn through a coiler tube of a coiler according to the present invention.

As best illustrated in FIGS. 6–8, the coiler 50 of the apparatus 20 preferably includes a supporting frame 100, a pair of feed rolls 31, 32 mounted on the supporting frame 100 and adapted for feeding yarn Y from a yarn source 21, and a coiler tube 51, preferably being rotatable as illustrated in FIGS. 6–7, positioned downstream from and cooperating with the pair of feed rolls 31, 32. The pair of feed rolls 31, 32 cooperate with the first yarn source 21 and the coiler tube 51 so as to feed the yarn Y supplied from the first yarn source 21 to the coiler tube 51 preferably by pneumatic means which preferably includes an elongate tube 24 or the like positioned upstream of the feed rolls 31, 32, as illustrated.

The pneumatic means is adapted for facilitating the movement of yarn Y from the yarn supply packages 22 to the feed rolls 31, 32. The elongate tube 24 preferably has an input end 24*a* adapted for receiving yarn Y from a yarn supply package 22 and an output end 24*b* positioned adjacent the pair of feed rolls 31, 32, as best illustrated in FIGS. 2 and 6–8. The pneumatic means is adapted to feed and guide the yarn Y from the yarn source 21 to the pair of feed rolls 31, 32. The pneumatic means as illustrated preferably also has a tube collar 25 mounted to the elongate tube 24 and an opening 25*a* (FIG. 8) therein positioned at the output end 24*b* thereof adjacent the pair of feed rolls 31, 32. An air vent tube 23 having first and second end portions 23*a*, 23*b* is connected by the second end portion 23*b* thereof to the elongate tube 24 at the opening 25*a* to operatively supply air from a compressed air source 28 to the output end 24*b* of the elongate tube 24. The air source 28 assists in drawing the yarn Y from the yarn source 21, through the elongate tube 24, and to the pair of feed rolls 31, 32 by supplying air under pressure through the air vent tube 23 to the elongate tube 24. A plurality of openings in the output end 24*b* of the elongate tube 24 as illustrated cooperate with the air being supplied from the air vent tube 23 to form the drawing-type action for the yarn Y. A valve 29 cooperates with the air source 28 and an air supply tube 28*a* so that by use of a button-type switch 29*a* of the valve 29 or the like, i.e., on or off control, the air supply process may be regulated for threadably drawing the yarn Y through the elongate tube 24.

The pair of feed rolls 31, 32 are preferably positioned closely adjacent each other, as best illustrated in FIGS. 6 and 8, so as to form a nip 34 therebetween. The feed rolls 31, 32 are also preferably positioned downstream from and closely adjacent to the elongate tube 24. The pair of feed rolls 31, 32 are further preferably mounted to rotate in opposite directions about respective core members 35, 36 having a generally central axis of rotation as illustrated by the directional arrows. Each of the rolls 31, 32 preferably have a respective fluted peripheral portion 31*a*, 32*a*, i.e., gear teeth, positioned to cooperate with the corresponding fluted peripheral portion 31*a*, 32*a*, i.e., gear teeth, of the other roll 31, 32 so that the driving of one roll 32 correspondingly drives the other roll 31.

Figure 9:
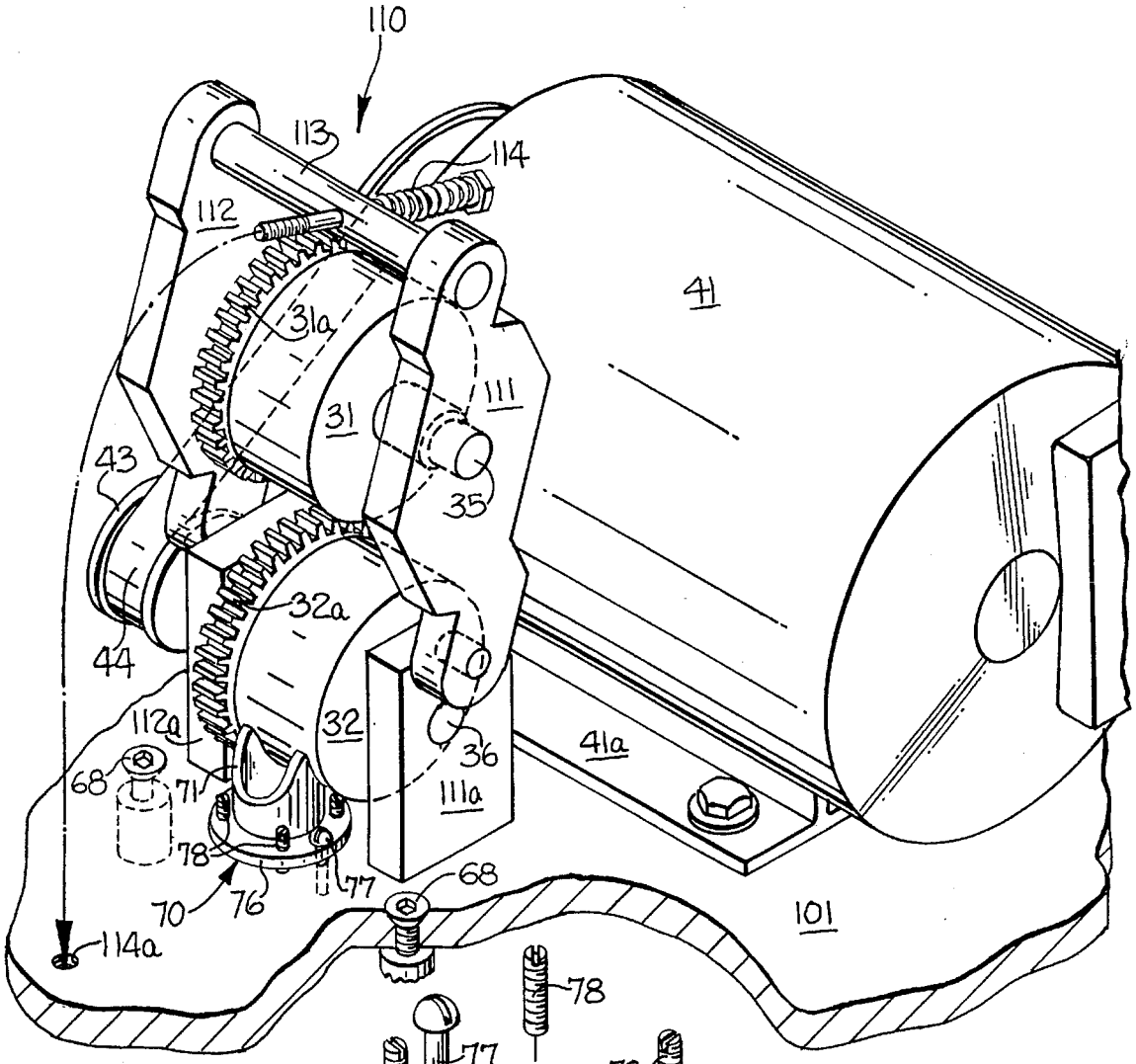
FIG. 9 illustrates a fragmentary and exploded view of an apparatus for forming coils of yarn taken from the general direction of arrow 9 of FIG. 5.
Figure 10:
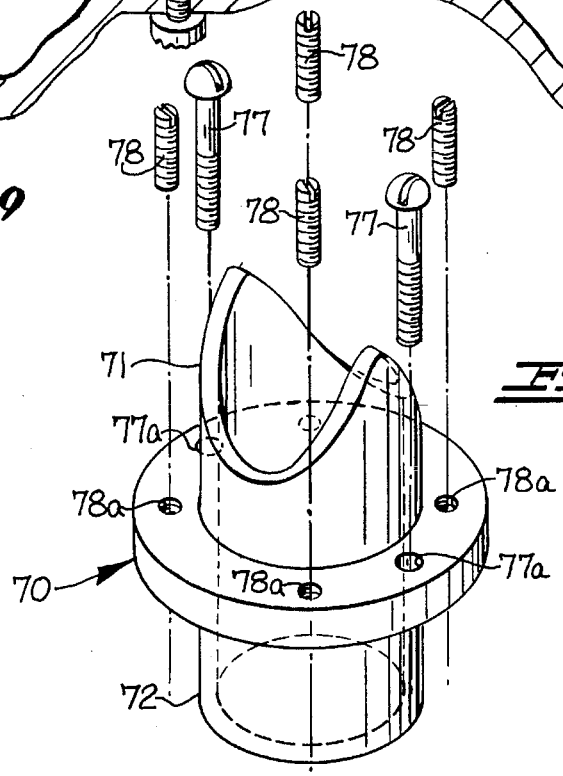
FIG. 10 illustrates an exploded view of a make-up guide tube assembly of a coiler according to the present invention.

As best illustrated in FIGS. 8–10, the pair of feed rolls 31, 32 are adapted to feed the yarn Y from the yarn source 21 during rotation thereof so that the yarn Y from the yarn source 21 travels through a trumpet member 39 positioned above and between the oppositely rotating rolls 31, 32, preferably at the nip 34, to the rotatable coiler tube 51. The yarn Y from the feed rolls 31, 32 passes or travels therefrom to a make-up guide tube assembly, broadly designated at 70, carried by the supporting frame 100. The make-up guide tube assembly 70 preferably includes a make-up guide tube 71 having lower portions depending from the supporting frame 100, an upper tapered end adapted to facilitate the positioning thereof closely adjacent lower portions of the feed rolls 31, 32, and a lower end preferably positioned within the confines of an upper end of the rotatable coiler tube 51. The make-up guide tube assembly also preferably includes adjusting means carried by the make-up guide tube 71 for adjustably positioning the tapered upper end thereof closely adjacent lower portions of the feed rolls 31, 32. The make-up guide tube 71 is non-rotatably mounted to a generally horizontal, structural plate member 101 of the supporting frame 100 and a lower portion 72 thereof extends through an opening in the structural plate member 101. The make-up guide tube 71 provides a make-up portion or transition portion for the corresponding distance between the feed rolls 31, 32 and the rotatable coiler tube 51 to thereby smoothly guide the yarn Y from the feed rolls 31, 32 to the coiler tube 51 without interference from the rotating feed rolls 31, 32.

As illustrated, the adjusting means of the make-up guide tube assembly 70 also includes an annular ring 76 surrounding a medial portion of the make-up guide tube 71 and preferably affixed thereto. The annular ring 76 extends outwardly from the make-up guide tube 71 so as to overlie the structural plate member 101 of the supporting frame 100. The adjusting means further has a plurality of leveling adjusters, shown as screws 78, which threadably extend through the annular ring 76 and with lower portions of the leveling screws 78 bearing against the structural plate member 101. Portions of the structural plate member 101 underlying the annular ring 76 have threaded bores therein. A plurality of fasteners, shown as securing screws 77, extend through the annular ring 76 and into the threaded bores to secure the make-up guide tube assembly 70 to the structurally supporting plate member 101.

The rotatable coiler tube 51 preferably has adjoining first and second portions. The first portion is positioned adjacent the feed rolls 31, 32 and extends downwardly therefrom. The second portion is preferably offset vertically from the first portion and also extends downwardly therefrom. The rotatable coiler tube 51 is therefore preferably angled and preferably has a first or upper end 52, a second or lower end 53, and a predetermined angle (θ), i.e., offset, formed in the tube positioned between the first and second ends 52, 53 thereof (see FIG. 6). The yarn Y preferably travels through the angled coiler tube 51 between the first and second ends 52, 53. The predetermined angle (θ) has a preferred range of about 5°–20° for various applications of the invention, but the range may also vary from about 0°–45° for some applications.

The first or upper end 52 of the coiler tube 51 preferably cooperates with lower end portion 72 of the make-up guide tube 71 so that the coiler tube 51 is positioned over the outer diameter of the make-up guide tube 71 to facilitate the transition between the two tubes 51, 71 and so that the coiler tube 51 may easily rotate around the lower portion of the make-up guide tube 71. The coiler tube 51 preferably has a relatively straight or first portion extending from the first end 52 to the angle (θ) and then the second portion extends outwardly in a relatively straight path from the angle (θ) as illustrated. Although a predetermined angle (θ) of about 9° in the coiler tube 51 is preferred, it will also be understood that other angles, i.e., greater than 45°, and shapes of the coiler tube 51 may also be used such as curvilinear shape or straight shape in some applications. During operation, however, the predetermined angle (θ) in the coiler tube 51 generally enables the coiler tube 51 to cooperate with the conveyor 90 so that the yarn Y is thrown outwardly in a circular pattern from the rotating coiler tube 51 and to prevent clogging of the yarn Y in the coiler tube 51 such as when the yarn Y is being fed from the pair of feed rolls 31, 32 at a predetermined speed.

A first variable speed drive 40 preferably is connected to the pair of feed rolls 31, 32 and mounted to the horizontal structural plate member 101. The first variable speed drive 40 is adapted for rotating the feed rolls 31, 32 at a predetermined speed to facilitate the feeding of the yarn Y from the yarn source 21 to the coiler tube 51. The first variable speed drive 40 preferably includes a first motor 41, such as a variable speed motor mounted on a base plate 41*a* as illustrated, and at least one drive pulley, and preferably a first pair of drive pulleys 42, 43 as illustrated. The first pair of drive pulleys 42, 43 are respectively connected to the motor 41 and at least one of the feed rolls 31, 32. A first drive belt 44 is preferably positioned on the drive pulleys 42, 43 and cooperates with the pair of feed rolls 31, 32 so that driving of the first motor 41 rotates the drive pulley 42 connected thereto, the first drive belt 44 positioned thereon, and the drive pulley connected to the feed rolls 31, 32 to thereby rotate the pair of feed rolls 31, 32 at a predetermined speed.

The first variable speed drive 40 and the feed rolls 31, 32 are preferably mounted on various structural support members as illustrated. One feed roll 32 is mounted along respective ends thereof to a pair of support blocks 111*a*, 112*a* fixedly secured to the supporting plate member 101 (FIGS. 6 and 9). Each support block 111*a*, 112*a* has a respective end member 111, 112 of a harness-type member 110 pivotally connected thereto. The harness-type member 110 includes first and second end members 111, 112 positioned along respective ends of the feed rolls 31, 32 and a rod member 113 extending between the end members 111, 112 and forming an outer-restraining end to the harness-type member 110. A fastener 114 secures the rod member 113 into an opening 114*a* in the plate member 101 in an operative position. The fastener 114 preferably includes a bolt having a spring mounted thereon as illustrated. The feed rolls 31, 32 are rotationally mounted on the core members 35, 36 which extend therethrough and connect to the respective end members 111, 112. Upon release of the fastener 114, the harness-type member 110 pivots about the support blocks 111*a*, 112*a* to provide access to the make-up guide tube 71 and a lower end of the feed rolls 31, 32.

The coiler 50 also preferably has a second variable speed drive 60, shown in the form of a second motor 61, also preferably a variable speed motor, a mounting flange 65, a second pair of drive pulleys 62, 63 respectively mounted to the second motor 61 and the mounting flange 65, and a second drive belt 64 that cooperates with the pair of drive pulleys 62, 63 as illustrated. The second variable speed drive 60 and the coiler tube 51 likewise are preferably mounted on various structural support members as illustrated. These various structural support members preferably connect to and cooperate with the horizontal structural plate member 101 supporting the first variable speed drive 40 and the feed rolls 31, 32. The plate member 101 is supported by generally vertical rod members 122, 123, 132, 133 (also shown are rod members 142, 152 in FIGS. 5 and 6 which cooperate with an adjacent apparatus 20 as illustrated in FIG. 1) and transverse beam members 121, 131. The transverse beam members 121, 131 cooperate with and are further supported by generally vertical beam members 125, 135 and transverse base members 136, (not shown), 126 or the like. The second motor 61 is preferably mounted to a generally vertical base plate 126 secured to and extending generally perpendicular to the horizontal plate member 101. The mounting flange 65 is preferably mounted to the plate member 101 by fasteners such as the threaded screws 68 illustrated (FIGS. 7 and 9), but may also be mounted to the vertical base plate 126, or other structural support member.

The angled and rotatable coiler tube 51 is preferably positioned in a substantially vertical direction above the conveyor 90 and upstream of the heating oven 80 so that the first end 52 of the coiler tube 51 is adapted to receive the yarn Y passing through the make-up guide tube 71, the yarn Y passes through the angled coiler tube 51 and out of the second end 53 thereof, and impinges on a surface 95 of the conveyor 90 and second variable speed drive 60. The driving of the second motor 61 drives, i.e., rotates, the drive pulley 62 connected thereto, rotates the second drive belt 64, and rotates the drive pulley connected to the mounting flange 65. The mounting flange 65 preferably includes bearings 66 positioned therein and rotatably cooperates with the rotatable coiler tube 51 so that the rotation of the drive pulley 63 connected thereto rotates the coiler tube 51 in a corresponding relationship, i.e., generally the same relative speed. A coiler tube ring member 55, i.e., collar, adjustably cooperates with the coiler tube 51, by use of an adjusting fastener 56, and the mounting flange 65 so that the coiler tube 51 as illustrated may be removed and replaced with other coiler tubes having various other predetermined angles formed therein, smaller or larger sized diameters, or other shapes or orientations as described.

Figure 3:
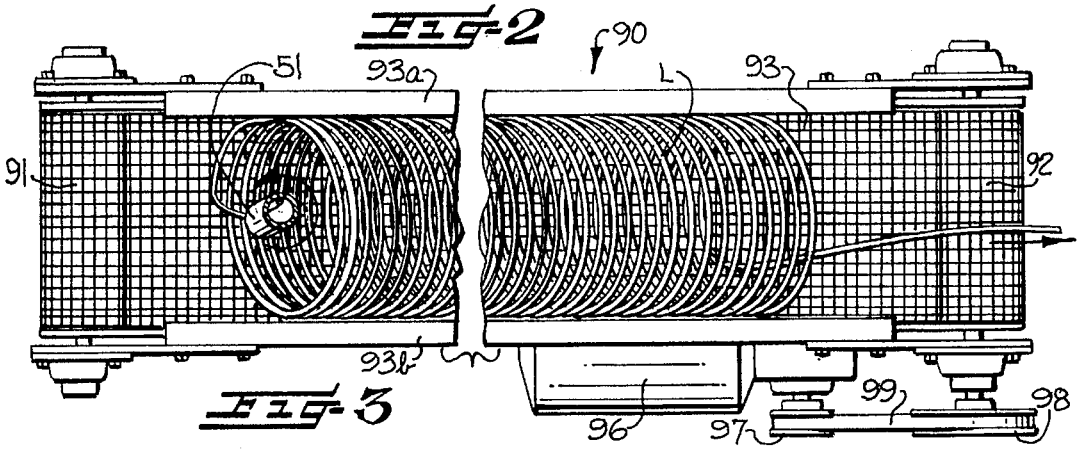
FIG. 3 illustrates a fragmentary top plan view of an apparatus for forming coils of yarn substantially taking the form of a plurality of larger-sized diameter loops of yarn being placed onto a moving conveyor at a first end thereof prior to travel through an enclosed heat setting oven and the loops being taken up on a second end of the conveyor after travel through the enclosed heat setting oven according to the present invention.
Figure 4:
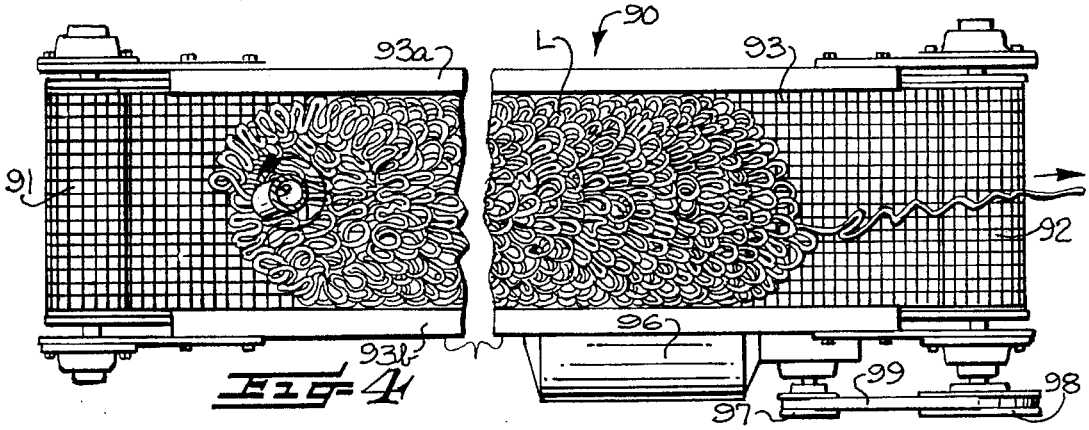
FIG. 4 illustrates a fragmentary top plan view of an apparatus for forming coils of yarn substantially taking the form of a plurality of smaller-sized diameter loops of yarn, i.e., clustered mass, being placed onto a conveyor at a first end thereof prior to travel through an enclosed heat setting oven and the loops being taken up on a second end of the conveyor after travel through the enclosed heat setting oven according to the present invention.
Figure 5:
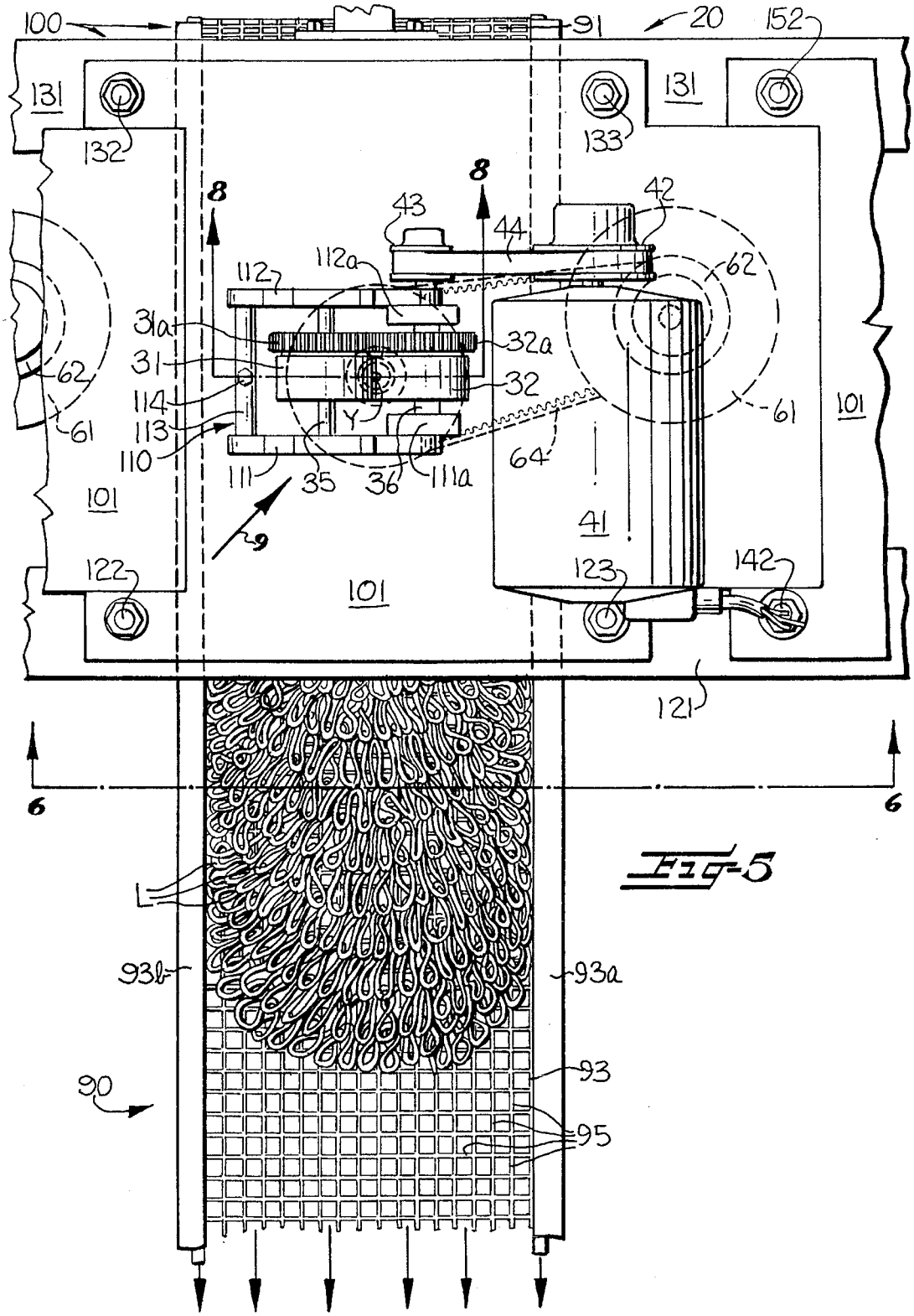
FIG. 5 illustrates a fragmentary top plan view of an apparatus for forming coils of yarn taken from the general direction of arrow 5 of FIG. 2 according to the present invention.

FIGS. 3 and 6, for example, illustrate the angled coiler tube 51 being rotated at a relatively fast speed so that the yarn Y is thrown out from the angled coiler tube 51 and deposited onto the moving conveyor 90 in relatively larger-sized diameter loops L. FIGS. 4 and 7, on the other hand, illustrate the angled coiler tube 51 being rotated at a relatively slow speed so that the yarn Y is thrown out from the angled coiler tube 51 and impingingly deposited onto the moving conveyor 90 in relatively smaller-sized diameter loops L. The plurality of smaller-sized loops L of yarn Y are also preferably oriented in a generally larger-sized diameter loop pattern which provides a textured appearance as best illustrated in FIGS. 4 and 5. The loops L in the yarn Y as described herein will be understood to include a shape or pattern of yarn substantially taking the form of a length of yarn folded over onto itself with an opening positioned therein, as well as other closed or nearly closed shapes or patterns in the yarn.

By providing the combination of these variable speed drives 40, 60 for the coiler 50, for example, in situations where high production output of yarn Y is important, the user of the apparatus 20 can advantageously adjust the feed speed of yarn Y through the coiler 50 to maximize the throughput of the yarn Y on the conveyor 90 into and through the heating oven 80. Also, based on the desired throughput, the user can then adjust the drive speed of the coiler tube 51 to select a predetermined pattern of loops L in the yarn Y. For example, the faster the drive speed of the rotatable coiler tube 51, more larger-sized loops L are formed in the yarn Y. The slower the drive rate of the coiler tube 51, fewer larger-sized loops L and more smaller-sized loops L are formed in the yarn Y.

The conveyor 90, as best illustrated in FIGS. 2–4, preferably includes at least two spaced apart drive rolls 91, 92 and a conveyor belt 93 horizontally extending between and positioned on the drive rolls 91, 92. The conveyor 90 also preferably includes a pair of conveyor guide rails 93*a*, 93*b* that provide a guide for the belt 93 as it travels between the spaced apart drive rolls 91, 92. An upper surface 95 of the conveyor belt 93 receives the loops L of yarn Y relatively upstream (FIG. 2) of the heating oven 80. The rotation of the conveyor drive rolls 91, 92 then feeds the loops L of yarn Y positioned on the conveyor belt 93 to, through, and from the heating oven 80. The conveyor belt 93 feeding the loops L of yarn Y preferably has a widthwise extent of about 9.125 inches, but as will be understood by those skilled in the art various other sizes of conveyor belts may also be used according to the invention. The apparatus 20 having the series of coilers 50 as illustrated in FIG. 1 preferably has about 7 inches between the series of conveyors 90 and about 16 9/16ths inches from the center of one conveyor 90 to the next.

The conveyor 90 preferably has a motor 96, preferably the third motor of the apparatus 20, mounted positionally below the conveyor belt 93. The motor 96 has a drive pulley 97 mounted thereto. One of the drive rolls 92 also has a drive pulley 98 mounted thereto and a drive belt 99 extends between the pair of drive pulleys 97, 98 so that the motor 96 drives the drive pulley 97 mounted thereto, the drive pulley 97 rotates the drive belt 99, and the drive belt 99, in turn, drives the drive pulley 98 mounted to the drive roll 92. The driving of the drive pulley 98 rotates the drive roll 92 which then drives the conveyor belt 93 generally as illustrated in FIGS. 2–4. The driving of the drive roll 92 having the conveyor belt 93 positioned thereon and cooperating therewith then drives, i.e., rotates, the other drive roll 91 to thereby feed or move the yarn Y positioned on the conveyor belt 93 from the coiler 50 downstream to the heating oven 80 and the yarn take-up means 26. The conveyor 90 is also preferably structurally supported by various generally vertical and transverse structural support members as best illustrated in FIGS. 3–4 and 6–7 and as previously described above.

The angled coiler tube 51 is also preferably positioned in a substantially vertical direction or orientation above the conveyor 90 so that the first end 52 of the angled coiler tube 51 receives the uncoiled yarn Y, the yarn Y passes through the angled coiler tube 51, and yarn received from the second tube end 53 is deposited onto a surface 95 of the conveyor 90. The surface 95 of the conveyor preferably has a textured pattern, such as the crisscross pattern illustrated, so that the yarn Y can easily cooperate with various machinery cooperating therewith, i.e., coiler 50, heating oven 80, yarn take-up means 26 and so that air, gases, or the like can more easily move or circulate around the yarn Y positioned thereon.

The loops L of yarn Y are preferably formed and received on the surface 95 of the conveyor 90 and then fed to the heating oven 80, preferably by the conveyor 90. The yarn heat setting oven 80 is preferably positioned to cooperate with the conveyor 90 and to substantially surround the conveyor belt 93 as it passes through the heating oven 80. The enclosed heating oven 80 is preferably adapted to receive the yarn Y on the conveyor belt 93 through a first opening 81 in the oven 80 (FIG. 2). The conveyor belt 93 feeds the yarn Y through the oven 80, and the yarn Y then passes from a second opening 82 in the oven 80. The yarn Y is conveyed through the heating oven 80 so that the yarn Y is heat set so as to maintain at least some of the predetermined shape therein. The yarn Y is cooled as it leaves the heating oven 80 and is fed to the yarn take-up means 26 for take-up and the individually packaging thereof.

As best illustrated in FIGS. 1 and 2, an apparatus 20 for forming coils of yarn Y and for heat setting the same may also include a series of coilers 50 positioned in a generally side-by-side arrangement and a plurality of supply packages 22 of yarn Y. Each of the yarn supply packages 22 are preferably positioned to feed yarn Y to a respective one of the series of coilers 50. A series of conveyors 90 extend generally parallel to each other. Each of the conveyors 90 is preferably positioned vertically below a respective coiler 50, extends a predetermined distance therefrom, and is adapted for receiving loops L of yarn Y thereon. An enclosed heating means, i.e., common heat setting oven 80, is positioned downstream from the series of coilers 50 and receives portions of each of the series of conveyors 90 therein for heating the loops L of yarn Y carried thereon so as to effect heat setting of the yarn Y. Each of the coilers 50 of the series is adapted to form yarn Y received from a yarn supply package 22 into a plurality of loops L of a desired size and preferably have the same structural and functional features as described above herein. The apparatus 20 having the series of coilers 50 may share a common heating oven 80, as best illustrated in FIGS. 1 and 2, and may share a common supporting frame 100, as best illustrated in FIGS. 5–7.

The apparatus 20 having the series of coilers 50 according to the present invention, however, is also preferably adapted so that at least two of the series of rotatable coiler tubes 51 of the series of coilers 50 are adapted to be variably driven at different desired speeds. This thereby provides an apparatus 20 wherein one of the series of rotatable coiler tubes 51 may be driven at a relatively slow speed responsive to the second variable speed drive 60 connected thereto while forming a clustered mass of relatively small loops L of yarn Y on a corresponding one of the series of conveyors 90 vertically positioned below the slowly rotating coiler tube 51 by impingingly depositing loops L of yarn Y onto the corresponding conveyor 90 at successively closely spaced areas. Also, either the same or a different one of the series of rotatable coiler tubes 51 of the series of coilers 50 may also be driven at a relatively fast speed responsive to the second variable speed drive 60 connected thereto. This allows the coiler 50 to form relatively large loops L of yarn Y on a corresponding one of the series of conveyers 90 vertically positioned below the fast rotating coiler tube 51 with substantially no undulations therein by depositing loops L of yarn Y onto the corresponding conveyor 90 at successively closely spaced areas.

Also, according to the present invention, methods of forming coils in a yarn Y as also described above herein are provided. A method of forming loops L of yarn Y deposited onto a moving conveyor 90 in preparation for heat setting to obtain a desired pattern of undulations is also provided. The method preferably includes the steps of providing the first variable speed drive 40 connected to the pair of feed rolls 31, 32, providing the second variable speed drive 60 connected to the rotatable coiler tube 51, and rotatingly driving the pair of feed rolls 31, 32 and the coiler tube 51 respectively responsive to the first and second variable speed drives 40, 60 at such speeds so as to form loops L of yarn Y of a desired size deposited on the conveyor 90. The second variable speed drive 60 connected to the rotatable coiler tube 51 may rotatingly drive the rotatable coiler tube 51 at a relatively slow speed to thereby form a clustered mass of relatively small loops L of yarn Y on the moving conveyor 90 by impingingly depositing loops L of yarn Y onto the moving conveyor 90 at successively closely spaced areas (FIG. 4). According to this method, an enclosed heating oven 80 is preferably positioned downstream from the coiler tube 51 and adapted to receive portions of the moving conveyor 90 therein (FIG. 2). The clustered mass of relatively small loops L of yarn Y positioned on portions of the moving conveyor 90 is received by the heating oven 80 and heated to thereby effect heat setting of the yarn Y so that the yarn Y emanating from the heating oven 80 has a substantially high degree of undulations therein as effected by the clustered mass of heat set yarn Y. The method also may include the step of rotatingly driving the rotatable coiler tube 51 at a relatively fast speed responsive to the second variable speed drive 60 connected thereto while forming relatively large loops L of yarn Y on the moving conveyer 90 with substantially no undulations therein by depositing loops L of yarn Y onto the moving conveyor 90 at successively closely spaced areas and likewise conveying the loops L of yarn Y to the enclosed heating setting oven 80 to thereby effect heat setting of the yarn Y (FIG. 3). The yarn Y emanating from the heating oven 80 is thereby substantially devoid of any undulations.

Further, as described in the apparatus 20 having the series of coilers 50, for example, another method of forming loops L of yarn Y deposited onto the moving conveyor 90 in preparation for heat setting to obtain a desired pattern of undulations according to the present invention is also provided. This method preferably includes the step of rotatingly driving a first rotatable coiler tube at a relatively slow speed responsive to a variable speed drive connected thereto while forming a clustered mass of relatively small loops L of yarn Y on a first moving conveyor by impingingly depositing loops L of yarn Y onto the first moving conveyor at successively closely spaced areas (FIG. 4). The method preferably further includes the step of rotatingly driving a second rotatable coiler tube at a relatively fast speed responsive to a variable speed drive connected thereto while forming relatively large loops L of yarn Y on a second moving conveyer with substantially no undulations therein by depositing loops L of yarn Y onto the second moving conveyor at successively closely spaced areas (FIG. 3). The first and second conveyors also preferably convey the loops L of yarn Y positioned thereon to a common enclosed heat setting oven 80 such as illustrated in FIGS. 1 and 2.

In the drawings and specification, there has been disclosed typical preferred embodiments of the invention and, although specific terms are employed, the terms are used in a descriptive sense only and not for the purposes of limitation. The invention has been described in considerable detail with specific reference to various illustrated embodiments. It will be apparent, however, that various modifications and changes can be made within the spirit and scope of the invention as described in the foregoing specification and defined in the appended claims.

That which is claimed is:

1. An apparatus for forming coils of yarn and for heat setting the same, the apparatus comprising:

a coiler positioned to receive yarn from a yarn source and to form the yarn into a plurality of loops of a desired size, said coiler comprising a supporting frame, a pair of feed rolls mounted on said supporting frame for feeding yarn from a yarn source, a rotatable coiler tube positioned downstream from and cooperating with said feed rolls, said coiler tube being vertically positioned for facilitating the travel of yarn from said feed rolls to and through said coiler tube, a first variable speed drive connected to said pair of feed rolls for rotating said pair of feed rolls at a predetermined speed, and a second variable speed drive connected to said coiler tube for rotating said coiler tube at a speed so as to form loops of yarn of a desired size;

a conveyor positioned below said rotatable coiler tube for receiving loops of yarn thereon, said conveyor extending a predetermined distance from said coiler tube whereby rotatingly driving said rotatable coiler tube at a relatively slow speed responsive to said second variable speed drive connected thereto and driving said pair of feed rolls at a relatively fast speed responsive to said first variable speed drive connected thereto forms a clustered mass of relatively small loops of yarn on said conveyor by depositing loops of yarn onto said conveyor at successively closely spaced areas and whereby rotatingly driving said rotatable coiler tube at a relatively fast speed responsive to said second variable speed drive connected thereto forms relatively large loops of yarn on said conveyer with substantially no undulations therein by depositing loops of yarn onto said conveyor at successively closely spaced areas; and enclosed heating means positioned downstream from said coiler and receiving portions of said conveyor therein for heating the loops of yarn carried thereon so as to effect heat setting of the yarn.

2. An apparatus as defined in claim 1, wherein said coiler further comprises a make-up guide tube assembly carried by said supporting frame and being positioned between said feed rolls and said coiler tube, said make-up guide tube assembly including a make-up guide tube having lower portions depending from said supporting frame, the upper end of said make-up guide tube being tapered so as to facilitate the positioning thereof closely adjacent lower portions of said feed rolls, and the lower end of said make-up guide tube being positioned within the confines of the upper end of said coiler tube.

3. An apparatus as defined in claim 2, wherein said make-up guide tube assembly further includes adjusting means carried by said make-up guide tube for adjustably positioning said tapered upper end thereof closely adjacent lower portions of said feed rolls.

4. An apparatus as defined in claim 3, wherein said adjusting means of said make-up guide tube assembly includes an annular ring surrounding a medial portion of said make-up guide tube and affixed thereto, said annular ring extending outwardly from said make-up guide tube so as to overlie said supporting frame, a plurality of leveling screws threadably extending through said annular ring and with lower portions of said screws bearing against said supporting frame, portions of said supporting frame underlying said annular ring having threaded bores therein, and a plurality of securing screws extending through said annular ring and into said threaded bores for securing said make-up guide tube assembly to said supporting frame.

5. An apparatus as defined in claim 1, wherein said supporting frame includes a horizontal plate and said first variable speed drive includes a first motor mounted on said horizontal plate, and wherein said supporting frame also includes a vertical plate extending downwardly from said horizontal plate, and said second variable speed drive includes a second motor mounted on said vertical plate.

6. An apparatus as defined in claim 1, wherein said rotatable coiler tube comprises an angled tube having adjoining first and second portions, said first portion being positioned adjacent said feed rolls and extending vertically downward therefrom, said second portion being offset vertically from said first portion and also extending downwardly therefrom.

7. An apparatus as defined in claim 1, further including pneumatic means for facilitating movement of the yarn from a yarn source to the feed rolls, said pneumatic means including an elongate tube having an input end for receiving yarn from a yarn source and an output end positioned adjacent said pair of feed rolls, and a compressed air source operatively connected to said output end of said elongate tube and being positioned to supply air to said output end so as to thread yarn through said elongate tube.

8. An apparatus for forming coils of yarn and for heat setting the same, the apparatus comprising:

a coiler adapted to receive yarn from a yarn source and to form the yarn into a plurality of loops of a desired size, said coiler comprising a supporting frame, a pair of feed rolls mounted on said supporting frame and adapted for feeding yarn from a yarn source, a rotatable coiler tube positioned downstream from and cooperating with said feed rolls, said coiler tube being vertically positioned for facilitating the travel of yarn from said feed rolls to and through said coiler tube, said coiler tube comprising an angled tube having adjoining first and second portions, said first portion being positioned adjacent said feed rolls and extending vertically downward therefrom, said second portion being offset vertically from said first portion and also extending downwardly therefrom, a make-up guide tube assembly carried by said supporting frame and being positioned between said feed rolls and said coiler tube, said make-up guide tube assembly including a make-up guide tube having lower portions depending from said supporting frame, the upper end of said make-up guide tube being tapered so as to facilitate the positioning thereof closely adjacent lower portions of said feed rolls, and the lower end of said make-up guide tube being positioned within the confines of the first portion of said coiler tube, a first variable speed drive connected to said pair of feed rolls and adapted for rotating said pair of feed rolls at a predetermined speed, and a second variable speed drive connected to said coiler tube for rotating said coiler tube at a speed so as to form loops of yarn of a desired size;

a conveyor positioned below said rotatable coiler tube for receiving loops of yarn thereon, said conveyor extending a predetermined distance from said coiler tube whereby rotatingly driving said rotatable coiler tube at a relatively slow speed responsive to the second variable speed drive connected thereto and driving said pair of feed rolls at a relatively fast speed responsive to said first variable speed drive connected thereto forms a clustered mass of relatively small loops of yarn on said conveyor by depositing loops of yarn onto said conveyor at successively closely spaced areas and whereby rotatingly driving said rotatable coiler tube at a relatively fast speed responsive to said second variable speed drive connected thereto forms relatively large loops of yarn on said conveyer with substantially no undulations therein by depositing loops of yarn onto said conveyor at successively closely spaced areas; and enclosed heating means positioned downstream from said coiler and receiving portions of said conveyor therein for heating the loops of yarn carried thereon so as to effect heat setting of the yarn.

9. An apparatus as defined in claim 8, wherein said make-up guide tube assembly further includes adjusting means carried by said make-up guide tube for adjustably positioning said tapered upper end thereof closely adjacent lower portions of said feed rolls.

10. An apparatus as defined in claim 9, wherein said adjusting means of said make-up guide tube assembly includes an annular ring surrounding a medial portion of said make-up guide tube and affixed thereto, said annular ring extending outwardly from said make-up guide tube so as to overlie said supporting frame, a plurality of leveling screws threadably extending through said annular ring and with lower portions of said screws bearing against said supporting frame, portions of said supporting frame underlying said annular ring having threaded bores therein, and a plurality of securing screws extending through said annular ring and into said threaded bores for securing said make-up guide tube assembly to said supporting frame.

11. An apparatus as defined in claim 8, wherein said supporting frame includes a horizontal plate and said first variable speed drive includes a first motor mounted on said horizontal plate, and wherein said supporting frame also includes a vertical plate extending downwardly from said horizontal plate, and said second variable speed drive includes a second motor mounted on said vertical plate.

12. An apparatus as defined in claim 8, further including pneumatic means for facilitating movement of the yarn from a yarn source to the feed rolls, said pneumatic means including an elongate tube having an input end for receiving yarn from a yarn source and an output end positioned adjacent said pair of feed rolls, and a compressed air source operatively connected to said output end of said elongate tube and being positioned to supply air to said output end so as to thread yarn through said elongate tube.

13. An apparatus for forming coils of yarn and for heat setting the same, the apparatus comprising:

a coiler positioned to receive yarn from a yarn source and to form the yarn into a plurality of loops of a desired size, said coiler comprising a supporting frame, said supporting frame including a horizontal plate and a vertical plate extending downwardly from said horizontal plate, a pair of feed rolls mounted on said horizontal plate and positioned for feeding yarn from a yarn source, a rotatable coiler tube positioned downstream from and cooperating with said feed rolls, said coiler tube being vertically positioned for facilitating the travel of yarn from said feed rolls to and through said coiler tube, said coiler tube comprising an angled tube having adjoining first and second portions, said first portion being positioned adjacent said feed rolls and extending vertically downward therefrom, said second portion being offset vertically from said first portion and also extending downwardly therefrom, a make-up guide tube assembly carried by said supporting frame and being positioned between said feed rolls and said coiler tube, said make-up guide tube assembly including a make-up guide tube having lower portions depending from said supporting frame, the upper end of said make-up guide tube being tapered so as to facilitate the positioning thereof closely adjacent lower portions of said feed rolls, and the lower end of said make-up guide tube being positioned within the confines of the first portion of said coiler tube, a first variable speed drive mounted on said horizontal plate of said supporting frame and connected to said pair of feed rolls, said first variable speed drive being positioned for rotating the pair of feed rolls at a predetermined speed, and a second variable speed drive mounted on said vertical plate of said supporting frame and connected to said coiler tube, said second variable speed drive being positioned for rotating the same at a speed so as to form loops of yarn of a desired size;

a conveyor positioned below said rotatable coiler tube for receiving loops of yarn thereon, said conveyor extending a predetermined distance from said coiler tube whereby rotatingly driving said rotatable coiler tube at a relatively slow speed responsive to said second variable speed drive connected thereto and driving said pair of feed rolls at a relatively fast speed responsive to said first variable speed drive connected thereto forms a clustered mass of relatively small loops of yarn on said conveyor by depositing loops of yarn onto said conveyor at successively closely spaced areas and whereby rotatingly driving said rotatable coiler tube at a relatively fast speed responsive to said second variable speed drive connected thereto forms relatively large loops of yarn on said conveyer with substantially no undulations therein by depositing loops of yarn onto said conveyor at successively closely spaced areas; and a heating oven positioned downstream from said coiler and receiving portions of said conveyor therein for heating the loops of yarn carried thereon so as to effect heat setting of the yarn.

14. An apparatus as defined in claim 13, wherein said make-up guide tube assembly further includes adjusting means carried by said make-up guide tube for adjustably positioning said tapered upper end thereof closely adjacent lower portions of said feed rolls.

15. An apparatus as defined in claim 14, wherein said adjusting means of said make-up guide tube assembly includes an annular ring surrounding a medial portion of said make-up guide tube and affixed thereto, said annular ring extending outwardly from said make-up guide tube so as to overlie portions of said horizontal plate of said supporting frame, a plurality of leveling screws threadably extending through said annular ring and with lower portions of said screws bearing against said horizontal plate, portions of said horizontal plate underlying said annular ring having threaded bores therein, and a plurality of securing screws extending through said annular ring and into said threaded bores for securing said make-up guide tube assembly to said horizontal plate of said supporting frame.

16. An apparatus as defined in claim 13, further including pneumatic means for facilitating movement of the yarn from a yarn source to the feed rolls, said pneumatic means including an elongate tube having an input end for receiving yarn from a yarn source and an output end positioned adjacent said pair of feed rolls, and a compressed air source operatively connected to said output end of said elongate tube and being positioned to supply air to said output end so as to thread yarn through said elongate tube.

17. An apparatus for forming loops of yarn and for heat setting the same, the apparatus comprising:

a series of coilers positioned in a generally side-by-side arrangement and adapted for forming loops of yarn;

a plurality of yarn supply packages, each of said yarn supply packages being positioned to feed yarn to a respective one of said series of coilers;

a series of conveyors extending generally parallel to each other, each of said conveyors being positioned below a respective coiler and extending forwardly a predetermined distance therefrom, and further being positioned for receiving loops of yarn thereon;

enclosed heating means positioned downstream from said series of coilers and receiving portions of each of said series of conveyors therein for heating the loops of yarns carried thereon so as to effect heat setting of the yarns; and wherein said series of coilers includes a common supporting frame having a horizontal plate and a plurality of vertical plates extending downwardly therefrom, each of said coilers of said series being adapted to receive yarn from one of said yarn supply packages and to form the yarn into a plurality of loops of a desired size, each coiler including a pair of feed rolls mounted on said horizontal plate of said supporting frame and adapted for feeding yarn from one of said yarn supply packages, each coiler also including a rotatable coiler tube positioned downstream from and cooperating with said feed rolls, each of said coiler tubes being vertically positioned for facilitating the travel of yarn from said feed rolls to and through said coiler tube, a first variable speed drive connected to each of said pairs of feed rolls for rotating said pairs of feed rolls at a predetermined speed, and a second variable speed drive connected to each of said coiler tubes for rotating said coiler tubes at a speed whereby rotatingly driving said rotatable coiler tubes at a relatively slow speed responsive to said second variable speed drives connected thereto and driving said pairs of feed rolls at a relatively fast speed responsive to said first variable speed drive connected thereto forms a clustered mass of relatively small loops of yarns on said conveyors by depositing loops of yarn onto said conveyors at successively closely spaced areas and whereby rotatingly driving said rotatable coiler tubes at a relatively fast speed responsive to said second variable speed drives connected thereto forms relatively large loops of yarns on said conveyers with substantially no undulations therein by depositing loops of yarns onto said conveyors at successively closely spaced areas.

18. An apparatus as defined in claim 17, wherein each of said coilers further includes a make-up guide tube assembly carried by said horizontal plate of said supporting frame and being positioned between said feed rolls and said coiler tube, each of said make-up guide tube assemblies including a make-up guide tube having lower portions depending from said horizontal plate, the upper end of said make-up guide tube being tapered so as to facilitate the positioning thereof closely adjacent lower portions of said feed rolls, and the lower end of said make-up guide tube being positioned within the confines of the upper end of said coiler tube.

19. An apparatus as defined in claim 18, wherein said make-up guide tube assembly of each coiler further includes adjusting means carried by said make-up guide tube for adjustably positioning said tapered upper end thereof closely adjacent lower portions of said feed rolls.

20. An apparatus as defined in claim 19, wherein said adjusting means of said make-up guide tube assemblies includes an annular ring surrounding a medial portion of said make-up guide tube and affixed thereto, said annular ring extending outwardly from said make-up guide tube so as to overlie portions of said horizontal plate, a plurality of leveling screws threadably extending through said annular ring and with lower portions of said screws bearing against said horizontal plate, the portions of said horizontal plate underlying said annular ring having threaded bores therein, and a plurality of securing screws extending through said annular ring and into said threaded bores for securing said make-up guide tube assembly to said horizontal plate.

21. An apparatus as defined in claim 17, wherein at least two of said series of rotatable coiler tubes are adapted to be variably driven at different desired speeds so that one of said series of rotatable coiler tubes is driven at a relatively slow speed responsive to said second variable speed drive connected thereto while forming a clustered mass of relatively small loops of yarn on a corresponding one of said series of conveyors vertically positioned below said slowly rotating coiler tube by impingingly depositing loops of yarn onto said corresponding conveyor at successively closely spaced areas and so that one of said series of rotatable coiler tubes is driven at a relatively fast speed responsive to said second variable speed drive connected thereto while forming relatively large loops of yarn on a corresponding one of said series of conveyers vertically positioned below said fast rotating coiler tube with substantially no undulations therein by depositing loops of yarn onto said corresponding conveyor at successively closely spaced areas.

22. An apparatus as defined in claim 17, wherein said first variable speed drive of each coiler includes a first motor mounted on said horizontal plate, and wherein said second variable speed drive of each coiler includes a second motor mounted on one of said plurality of vertical plates.

23. An apparatus as defined in claim 17, wherein said rotatable coiler tube of each coiler comprises an angled tube having adjoining first and second portions, said first portion being positioned adjacent said feed rolls and extending vertically downward therefrom, said second portion being offset vertically from said first portion and also extending downwardly therefrom.

24. An apparatus as defined in claim 17, further including a series of pneumatic means for facilitating movement of yarn from said yarn supply packages to said feed rolls, each of said pneumatic means being positioned adjacent a respective coiler of said series of coilers and includes an elongate tube having an input end for receiving yarn from one of said yarn supply packages and an output end positioned adjacent said pair of feed rolls, and a compressed air source operatively connected to said output end of said elongate tube and being positioned to supply air to said output end so as to thread yarn through said elongate tube.

25. An apparatus as defined in claim 17, wherein said series of conveyors extend through and beyond said enclosed heating means, and wherein the apparatus further comprises take-up means positioned adjacent the terminal end of the conveyors for separately winding the heat treated yarns to form individual packages thereof.

26. An apparatus for forming coils of yarn and for heat setting the same, the apparatus comprising:

a series of coilers positioned in a generally side-by-side arrangement;

a plurality of yarn supply packages, each of said yarn supply packages being positioned to feed yarn to a respective one of said series of coilers;

a series of conveyors extending generally parallel to each other, each of said conveyors being positioned below a respective coiler and extending forwardly a predetermined distance therefrom, and further being positioned for receiving loops of yarn thereon;

enclosed heating means positioned downstream from said series of coilers and receiving portions of each of said series of conveyors therein for heating the loops of yarns carried thereon so as to effect heat setting of the yarns; and wherein each of said coilers of said series being adapted to receive yarn from one of said yarn supply packages into a plurality of loops of a desired size, each coiler including a pair of feed rolls mounted on said horizontal plate of said supporting frame and adapted for feeding yarn from one of said yarn supply packages, each coiler also including a rotatable coiler tube positioned downstream from and cooperating with said feed rolls, each of said coiler tubes being vertically positioned for facilitating the travel of yarn from said feed rolls to and through said coiler tube, said coiler tube comprising an angled tube having adjoining first and second portions, said first portion being positioned adjacent said feed rolls and extending vertically downward therefrom, said second portion being offset vertically from said first portion and also extending downwardly therefrom, a make-up guide tube assembly carried by said horizontal plate and being positioned between said feed rolls and said coiler tube, said make-up guide tube assembly including a make-up guide tube having lower portions depending from said horizontal plate, the upper end of said make-up guide tube being tapered so as to facilitate the positioning thereof closely adjacent lower portions of said feed rolls, and the lower end of said make-up guide tube being positioned within the confines of the first portion of said coiler tube, a first variable speed drive connected to each of said pairs of feed rolls for rotating said pairs of feed rolls at a predetermined speed, and a second variable speed drive connected to each of said coiler tubes for rotating the same at a speed whereby rotatingly driving said rotatable coiler tubes at a relatively slow speed responsive to said second variable speed drives connected thereto and driving said pairs of feed rolls at a relatively fast speed responsive to said first variable speed drive connected thereto forms a clustered mass of relatively small loops of yarns on said conveyors by depositing loops of yarn onto said conveyors at successively closely spaced areas and whereby rotatingly driving said rotatable coiler tubes at a relatively fast speed responsive to said second variable speed drives connected thereto forms relatively large loops of yarns on said conveyers with substantially no undulations therein by depositing loops of yarns onto said conveyors at successively closely spaced areas.

27. An apparatus as defined in claim 26, wherein said make-up guide tube assembly of each coiler further includes adjusting means carried by said make-up guide tube for adjustably positioning said tapered upper end thereof closely adjacent lower portions of said feed rolls.

28. An apparatus as defined in claim 27, wherein each of said adjusting means of said make-up guide tube assemblies includes an annular ring surrounding a medial portion of said make-up guide tube and affixed thereto, said annular ring extending outwardly from said make-up guide tube so as to overlie portions of said horizontal plate, a plurality of leveling screws threadably extending through said annular ring and with lower portions of said screws bearing against said horizontal plate, the portions of said horizontal plate underlying said annular ring having threaded bores therein, and a plurality of securing screws extending through said annular ring and into said threaded bores for securing said make-up guide tube assembly to said horizontal plate.

29. An apparatus as defined in claim 26, wherein at least two of said series of rotatable coiler tubes are adapted to be variably driven at different desired speeds so that one of said series of rotatable coiler tubes is driven at a relatively slow speed responsive to said second variable speed drive connected thereto while forming a clustered mass of relatively small loops of yarn on a corresponding one of said series of conveyors vertically positioned below said slowly rotating coiler tube by impingingly depositing loops of yarn onto said corresponding conveyor at successively closely spaced areas and so that one of said series of rotatable coiler tubes is driven at a relatively fast speed responsive to said second variable speed drive connected thereto while forming relatively large loops of yarn on a corresponding one of said series of conveyers vertically positioned below said fast rotating coiler tube with substantially no undulations therein by depositing loops of yarn onto said corresponding conveyor at successively closely spaced areas.

30. An apparatus as defined in claim 28, wherein said first variable speed drive of each coiler includes a first motor mounted on said horizontal plate, and wherein second variable speed drive of each coiler includes a second motor mounted on one of said plurality of vertical plates.

31. An apparatus as defined in claim 26, further including a series of pneumatic means for facilitating movement of the yarn from said yarn supply packages to the feed rolls, each of said pneumatic means positioned adjacent a respective coiler of the series of coilers and including an elongate tube having an input end for receiving yarn from a yarn supply package and an output end positioned adjacent said pair of feed rolls, and a compressed air source operatively connected to said output end of said elongate tube and being positioned to supply air to said output end so as to thread yarn through said elongate tube.

32. An apparatus as defined in claim 26, wherein said series of conveyors extend through and beyond said enclosed heating means, and wherein the apparatus further comprises take-up means positioned adjacent the terminal end of the conveyors for separately winding the heat treated yarns to form individual packages thereof.

33. A coiler for receiving yarn from a yarn source and for forming loops of yarn of a desired size, the coiler comprising:

a supporting frame;

a pair of feed rolls mounted on said supporting frame for feeding yarn from a yarn source;

a rotatable coiler tube positioned downstream from and cooperating with said feed rolls, said coiler tube being vertically positioned for facilitating the travel of yarn from said feed rolls to and through said coiler tube;

a first variable speed drive connected to said pair of feed rolls for rotating said pair of feed rolls at a predetermined speed; and a second variable speed drive connected to said coiler tube for rotating said coiler tube at a speed so as to form loops of yarn of a desired size whereby rotatingly driving said rotatable coiler tube at a relatively slow speed responsive to said second variable speed drive connected thereto and driving said pair of feed rolls at a relatively fast speed responsive to said first variable speed drive connected thereto forms a clustered mass of relatively small loops of yarn at successively closely spaced areas and whereby rotatingly driving said rotatable coiler tube at a relatively fast speed responsive to said second variable speed drive connected thereto forms relatively large loops of yarn with substantially no undulations therein at successively closely spaced areas.

34. A coiler as defined in claim 33, wherein said coiler further comprises a make-up guide tube assembly carried by said supporting frame and being positioned between said feed rolls and said coiler tube, said make-up guide tube assembly including a make-up guide tube having lower portions depending from said supporting frame, the upper end of said make-up guide tube being tapered so as to facilitate the positioning thereof closely adjacent lower portions of said feed rolls, and the lower end of said make-up guide tube being positioned within the confines of the upper end of said coiler tube.

35. A coiler as defined in claim 34, wherein said make-up guide tube assembly further includes adjusting means carried by said make-up guide tube for adjustably positioning said tapered upper end thereof closely adjacent lower portions of said feed rolls.

36. A coiler as defined in claim 35, wherein said adjusting means of said make-up guide tube assembly includes an annular ring surrounding a medial portion of said make-up guide tube and affixed thereto, said annular ring extending outwardly from said make-up guide tube so as to overlie said supporting frame, a plurality of leveling screws threadably extending through said annular ring and with lower portions of said screws bearing against said supporting frame, portions of said supporting frame underlying said annular ring having threaded bores therein, and a plurality of securing screws extending through said annular ring and into said threaded bores for securing said make-up guide tube assembly to said supporting frame.

37. A coiler as defined in claim 33, wherein said supporting frame includes a horizontal plate and said first variable speed drive includes a first motor mounted on said horizontal plate, and wherein said supporting frame also includes a vertical plate extending downwardly from said horizontal plate, and said second variable speed drive includes a second motor mounted on said vertical plate.

38. A coiler as defined in claim 33, wherein said rotatable coiler tube comprises an angled tube having adjoining first and second portions, said first portion being positioned adjacent said feed rolls and extending vertically downward therefrom, said second portion being offset vertically from said first portion and also extending downwardly therefrom.

39. A coiler for receiving yarn from a yarn source and for forming loops of yarn of a desired size, the coiler comprising:

a supporting frame;

a pair of feed rolls mounted on said supporting frame for feeding yarn from a yarn source;

a rotatable coiler tube positioned downstream from and cooperating with said feed rolls, said coiler tube being vertically positioned for facilitating the travel of yarn from said feed rolls to and through said coiler tube, said coiler tube comprising an angled tube having adjoining first and second portions, said first portion being positioned adjacent said feed rolls and extending vertically downward therefrom, said second portion being offset vertically from said first portion and also extending downwardly therefrom;

a make-up guide tube assembly carried by said supporting frame and being positioned between said feed rolls and said coiler tube, said make-up guide tube assembly including a make-up guide tube having lower portions depending from said supporting frame, the upper end of said make-up guide tube being tapered so as to facilitate the positioning thereof closely adjacent lower portions of said feed rolls, and the lower end of said make-up guide tube being positioned within the confines of the first portion of said coiler tube;

a first variable speed drive connected to said pair of feed rolls for rotating said pair of feed rolls at a predetermined speed; and a second variable speed drive connected to said coiler tube for rotating said coiler tube at a speed whereby rotatingly driving said rotatable coiler tube at a relatively slow speed responsive to said second variable speed drive connected thereto and driving said pair of feed rolls at a relatively fast speed responsive to said first variable speed drive connected thereto forms a clustered mass of relatively small loops of yarn at successively closely spaced areas and whereby rotatingly driving said rotatable coiler tube at a relatively fast speed responsive to the second variable speed drive connected thereto forms relatively large loops of yarn with substantially no undulations therein at successively closely spaced areas.

40. A coiler as defined in claim 39, wherein said make-up guide tube assembly further includes adjusting means carried by said make-up guide tube for adjustably positioning said tapered upper end thereof closely adjacent lower portions of said feed rolls.

41. A coiler as defined in claim 40, wherein said adjusting means of said make-up guide tube assembly includes an annular ring surrounding a medial portion of said make-up guide tube and affixed thereto, said annular ring extending outwardly from said make-up guide tube so as to overlie said supporting frame, a plurality of leveling screws threadably extending through said annular ring and with lower portions of said screws bearing against said supporting frame, portions of said supporting frame underlying said annular ring having threaded bores therein, and a plurality of securing screws extending through said annular ring and into said threaded bores for securing said make-up guide tube assembly to said supporting frame.

42. A coiler as defined in claim 41, wherein said supporting frame includes a horizontal plate and said first variable speed drive includes a first motor mounted on said horizontal plate, and wherein said supporting frame also includes a vertical plate extending downwardly from said horizontal plate, and said second variable speed drive includes a second motor mounted on said vertical plate.

43. A method of forming loops of yarn on a moving conveyor in preparation for heat setting the yarn to obtain a desired pattern of undulations in the yarn, the method comprising the steps of:

providing a first variable speed drive connected to a pair of feed rolls;

providing a second variable speed drive connected to a rotatable coiler tube; and rotatingly driving the rotatable coiler tube at a relatively slow speed responsive to the second variable speed drive connected thereto and rotatingly driving the pair of feed rolls at a relatively fast speed responsive to the first variable speed drive connected thereto so as to form a clustered mass of relatively small loops of yarn on the moving conveyor by impingingly depositing small loops of the yarn onto the moving conveyor in overlapping relation.

44. A method as defined by claim 43, further comprising the step of:

providing an enclosed heating oven positioned downstream from the coiler tube to receive portions of the moving conveyor therein; and heating the clustered mass of relatively small loops of yarn on the moving conveyor received so as to effect heat setting of the yarn so that the yarn emanating from the heating oven has a substantially high degree of heat set undulations therein as effected by the clustered mass of heat set yarn.

45. A method of forming loops of yarn deposited on a moving conveyor in preparation for heat setting to obtain a desired pattern of undulations, the method comprising the steps of:

providing a first variable speed drive connected to a pair of feed rolls;

providing a second variable speed drive connected to a rotatable coiler tube rotatingly driving the rotatable coiler tube at a relatively slow speed responsive to the second variable speed drive connected thereto and correspondingly driving the pair of feed rolls at a relatively fast speed responsive to the first variable speed drive connected thereto so as to form a clustered mass of relatively small loops of yarn on the moving conveyor by depositing loops of yarn onto the moving conveyor at successively closely spaced areas; and rotatingly driving the rotatable coiler tube at a relatively fast speed responsive to the second variable speed drive connected so as to form relatively large loops of yarn on the moving conveyer with substantially no undulations therein by depositing loops of yarn onto the moving conveyor at successively closely spaced areas.

46. A method as defined by claim 45, further comprising the step of:

providing an enclosed heating oven positioned downstream from the coiler tube and positioned to receive portions of the moving conveyor therein;

conveying loops of yarn deposited on the moving conveyor to the heating oven; and heating the loops of yarn on the moving conveyor to effect heat setting of the yarn.

47. A method of forming loops of yarn deposited onto a moving conveyor in preparation for heat setting to obtain a desired pattern of undulations, the method comprising the steps of:

rotatingly driving a rotatable coiler tube at a relatively slow speed responsive to a variable speed drive connected thereto while forming a clustered mass of relatively small loops of yarn on a moving conveyor by impingingly depositing loops of yarn onto the moving conveyor at successively closely spaced areas; and rotatingly driving the same rotatable coiler tube at a relatively fast speed responsive to the variable speed drive connected thereto while forming relatively large loops of yarn on the same moving conveyer with substantially no undulations therein by depositing loops of yarn onto the moving conveyor at successively closely spaced areas.

48. A method as defined by claim 47, further comprising the steps of:

conveying the loops of yarn deposited on the moving conveyor to a heating zone; and heating the loops of yarn positioned on portions of the moving conveyor received by the heating zone to thereby effect heat setting of the yarn.

49. An apparatus for forming coils of yarn and for heat setting the same, the apparatus comprising:

a coiler positioned to receive yarn from a yarn source and to form the yarn into a plurality of loops of a desired size, said coiler comprising a supporting frame, a pair of feed rolls mounted on said supporting frame and adapted for feeding yarn from a yarn source, a rotatable coiler tube positioned downstream from and cooperating with said feed rolls, said coiler tube being vertically positioned for facilitating the travel of yarn from said feed rolls to and through said coiler tube, a make-up guide tube assembly carried by said supporting frame and being positioned between said feed rolls and said coiler tube, said make-up guide tube assembly including a make-up guide tube having lower portions depending from said supporting frame, the upper end of said make-up guide tube being tapered so as to facilitate the positioning thereof closely adjacent lower portions of said feed rolls, and the lower end of said make-up guide tube being positioned within the confines of the upper end of said coiler tube, said make-up guide tube assembly further including adjusting means carried by said make-up guide tube for adjustably positioning said tapered upper end thereof closely adjacent lower portions of said feed rolls a first variable speed drive connected to said pair of feed rolls for rotating said pair of feed rolls at a predetermined speed, and a second variable speed drive connected to said coiler tube for rotating said coiler tube at a speed so as to form loops of yarn of a desired size;

a conveyor positioned below said rotatable coiler tube for receiving loops of yarn thereon, said conveyor extending a predetermined distance from said coiler tube; and enclosed heating means positioned downstream from said coiler and receiving portions of said conveyor therein for heating the loops of yarn carried thereon so as to effect heat setting of the yarn.

50. An apparatus for forming loops of yarn and for heat setting the same, the apparatus comprising:

a series of coilers positioned in a generally side-by-side arrangement and adapted for forming loops of yarn;

a plurality of yarn supply packages, each of said yarn supply packages being positioned to feed yarn to a respective one of said series of coilers;

a series of conveyors extending generally parallel to each other, each of said conveyors being positioned below a respective coiler and extending forwardly a predetermined distance therefrom for receiving loops of yarn thereon;

enclosed heating means positioned downstream from said series of coilers and receiving portions of each of said series of conveyors therein for heating the loops of yarns carried thereon so as to effect heat setting of the yarns; and wherein said series of coilers includes a common supporting frame having a horizontal plate and a plurality of vertical plates extending downwardly therefrom, each of said coilers of said series being positioned to receive yarn from one of said yarn supply packages and to form the yarn into a plurality of loops of a desired size, each coiler including a pair of feed rolls mounted on said horizontal plate of said supporting frame for feeding yarn from one of said yarn supply packages, each coiler also including a rotatable coiler tube positioned downstream from and cooperating with said feed rolls, each of said coiler tubes being vertically positioned for facilitating the travel of yarn from said feed rolls to and through said coiler tube, a make-up guide tube assembly carried by said horizontal plate of said supporting frame and being positioned between said feed rolls and said coiler tube, each of said make-up guide tube assemblies including a make-up guide tube having lower portions depending from said horizontal plate, the upper end of said make-up guide tube being tapered so as to facilitate the positioning thereof closely adjacent lower portions of said feed rolls, and the lower end of said make-up guide tube being positioned within the confines of the upper end of said coiler tube, said make-up guide tube assembly of each coiler further including adjusting means carried by said make-up guide tube for adjustably positioning said tapered upper end thereof closely adjacent lower portions of said feed rolls, a first variable speed drive connected to each of said pairs of feed rolls for rotating said pairs of feed rolls at a predetermined speed, and a second variable speed drive connected to each of said coiler tubes for rotating said coiler tubes at a speed so as to form loops of yarn of a desired size.

51. A coiler for receiving yarn from a yarn source and for forming loops of yarn of a desired size, the coiler comprising:

a supporting frame;

a pair of feed rolls mounted on said supporting frame for feeding yarn from a yarn source;

a rotatable coiler tube positioned downstream from and cooperating with said feed rolls, said coiler tube being vertically positioned for facilitating the travel of yarn from said feed rolls to and through said coiler tube;

a make-up guide tube assembly carried by said supporting frame and being positioned between said feed rolls and said coiler tube, said make-up guide tube assembly including a make-up guide tube having lower portions depending from said supporting frame, the upper end of said make-up guide tube being tapered so as to facilitate the positioning thereof closely adjacent lower portions of said feed rolls, and the lower end of said make-up guide tube being positioned within the confines of the upper end of said coiler tube, said make-up guide tube assembly further including adjusting means carried by said make-up guide tube for adjustably positioning said tapered upper end thereof closely adjacent lower portions of said feed rolls;

a first variable speed drive connected to said pair of feed rolls for rotating said pair of feed rolls at a predetermined speed; and a second variable speed drive connected to said coiler tube for rotating said coiler tube at a speed so as to form loops of yarn of a desired size.

* * * * *